US009761921B2

(12) United States Patent
Mansour et al.

(10) Patent No.: US 9,761,921 B2
(45) Date of Patent: Sep. 12, 2017

(54) TUNABLE BANDPASS FILTER

(71) Applicant: HUAWEI TECHNOLOGIES CANADA CO., LTD., Kanata (CA)

(72) Inventors: Raafat R. Mansour, Waterloo (CA); Kevin Yang, Kitchener (CA); Vahid Miraftab, Ottawa (CA)

(73) Assignee: HUAWEI TECHNOLOGIES CANADA CO., LTD., Kanata (CA)

( * ) Notice: Subject to any disclaimer, the term of this patent is extended or adjusted under 35 U.S.C. 154(b) by 155 days.

(21) Appl. No.: 14/962,855

(22) Filed: Dec. 8, 2015

(65) Prior Publication Data

US 2017/0162925 A1 Jun. 8, 2017

(51) Int. Cl.
*H01P 1/38* (2006.01)
*H01P 1/201* (2006.01)

(52) U.S. Cl.
CPC ..... *H01P 1/201* (2013.01); *H01P 1/38* (2013.01)

(58) Field of Classification Search
CPC .. H01P 1/38; H01P 1/383; H01P 1/387; H01P 1/32; H01P 1/36; H01P 1/20; H01P 1/201
USPC ..... 333/1.1, 24.2
See application file for complete search history.

(56) References Cited

U.S. PATENT DOCUMENTS 4,292,607 A * 9/1981 Goldie ..... H01P 1/213 330/126
5,721,521 A * 2/1998 Drabeck ..... H01P 1/20 333/176
7,733,814 B1 * 6/2010 Rausch ..... H04B 1/0057 333/1.1
2013/0142089 A1 6/2013 Azarnaminy et al.
2013/0162374 A1 6/2013 Tamiazzo et al.
2013/0281031 A1 10/2013 Gingrich et al.

FOREIGN PATENT DOCUMENTS

CN 101567674 A 10/2009
CN 204681323 U 9/2015
KR 100556621 B1 3/2006
WO 2008042998 A2 4/2008

OTHER PUBLICATIONS

Torregrosa-Penalva, Germán, López-Risueno, Gustavo, Alonso, José, et al. A simple method to design wide-band electronically tunable combline filters. Microwave Theory and Techniques, IEEE Transactions on, 2002, vol. 50, No. 1, p. 172-177.

(Continued)

*Primary Examiner* — Stephen E Jones
(74) *Attorney, Agent, or Firm* — Norton Rose Fulbright Canada LLP (Huawei)

(57) ABSTRACT

The tunable bandpass filter is used for filtering an electromagnetic signal, has a system passband between a first and a second tunable cutoff frequencies, and has a first subfilter and a second subfilter connected to one another in series between an input port and an output port and being complementary to one another in the tunable bandpass filter. At least one of the first subfilter and the second subfilter being connected to operate in reflection.

19 Claims, 19 Drawing Sheets

(56) References Cited

OTHER PUBLICATIONS

Brown, Andrew R. et Rebeiz, Gabriel M. A varactor-tuned RF filter. Microwave Theory and Techniques, IEEE Transactions on, 2000, vol. 48, No. 7, p. 1157-1160.

Chandler, S. R., Hunter, I. C., et Gardiner, J. G. Active varactor tunable bandpass filter. Microwave and Guided Wave Letters, IEEE, 1993, vol. 3, No. 3, p. 70-71.

Uher, Jaroslaw, Arndt, Fritz, et Bornemann, Jens. Computer-aided design and improved performance of tunable ferrite-loaded E-plane integrated circuit filters for millimeter-wave applications. Microwave Theory and Techniques, IEEE Transactions on, 1988, vol. 36, No. 12, p. 1841-1849.

Abbaspour-Tamijani, Abbas, Dussopt, Laurent, et Rebeiz, Gabriel M. Miniature and tunable filters using MEMS capacitors. Microwave Theory and Techniques, IEEE Transactions on, 2003, vol. 51, No. 7, p. 1878-1885.

Zhang, R. et Mansour, R. R. Novel tunable lowpass filters using folded slots etched in the ground plane. In : Microwave Symposium Digest, 2005 IEEE MTT-S International. IEEE, 2005. p. 4 pp.

Miraftab, Vahid et Yu, Ming. Advanced coupling matrix and admittance function synthesis techniques for dissipative microwave filters. Microwave Theory and Techniques, IEEE Transactions on, 2009, vol. 57, No. 10, p. 2429-2438.

Fouladi, Siamak, Huang, Fengxi, Yan, Winter Dong, et al. Combline tunable bandpass filter using RF-MEMS switched capacitor bank. In : Microwave Symposium Digest (MTT), 2012 IEEE MTT-S International. IEEE, 2012. p. 1-3.

Yan, Winter Dong et Mansour, Raafat R. Tunable dielectric resonator bandpass filter with embedded MEMS tuning elements. Microwave Theory and Techniques, IEEE Transactions on, 2007, vol. 55, No. 1, p. 154-160.

Tsutsumi, Makoto et Okubo, Kensuke. On the YIG film filters. In : Microwave Symposium Digest, 1992., IEEE MTT-S International. IEEE, 1992. p. 1397-1400.

Yun, Tae-Yeoul et Chang, Kai. Piezoelectric-transducer-controlled tunable microwave circuits. Microwave Theory and Techniques, IEEE Transactions on, 2002, vol. 50, No. 5, p. 1303-1310.

Moeckly, Brian H. et Zhang, Yongming. Strontium titanate thin films for tunable YBa2Cu3O7 microwave filters. IEEE transactions on applied superconductivity, 2001, vol. 11, No. 1, p. 450-453.

Tombak, Ali, Ayguavives, Francisco T., Maria, J.-P., et al. Tunable RF filters using thin film barium strontium titanate based capacitors. In : Microwave Symposium Digest, 2001 IEEE MTT-S International. IEEE, 2001. p. 1453-1456.

Rebeiz, G. et Goldsmith, C. "WMB: MEMS, BAW, and micromachined filter technology," in Proc. 2004 IEEE MTT-S Int. Microwave Symp. Dig., IMS Workshop, Jun. 2004, pp. 12-13.

SIPO of the P.R China; International Search Report and Written Opinion is5 pagessued in corresponding international application No. PCT/CN2016//098536 dated Dec. 13, 2016.

* cited by examiner

TUNABLE BANDPASS FILTER

FIELD

The improvements generally relate to the field of optical filters, and more specifically, to tunable bandpass filters.

BACKGROUND

Electromagnetic wave filters are used in a wide variety of applications. Filters are used to eliminate some frequencies (referred to as the rejection band) from a signal. The frequencies which are not eliminated are referred to as the passband. When the frequencies the filter acts upon are in the microwave portion of the electromagnetic spectrum, the filter can be referred to as a microwave filter. The edge, or edges, of the rejection band are typically referred to as a cutoff. Considerations when selecting a filter include sharpness of the cutoff (also referred to in the field as skirt steepness and roll-off) and Q factor. The sharpness of the cutoff can affect the narrowness of a passband, for instance. Tunability of the cutoff frequency is required in some applications, such as in reconfigurable communication systems. It is known to provide tunability of such filters in a mechanical manner using means such as a motor mechanism or other mechanical structure. However, this technique has disadvantages such as size, cost, performance limitations, etc.

High quality factor (High-Q) tunable filters are needed in both wireless and satellite systems. Tunability and re-configurability in these systems can offer great flexibility and economic benefits. For example, one of the challenges facing wireless service providers is the real-estate cost during base station installation in urban areas. The inclusion of tunable filters that integrate many functions, such as multi-standard and multiband filters, into one site provides an economic incentive for the wireless service provider to incorporate tunable filters into the base station instead of fixed-frequency filters. In satellite systems, use of tunable filters can significantly reduce the size and mass of the payload due to multimode and multifunctional operation and re configurability such filters offer. This reduction in mass and size has an economic impact on the cost of satellite systems as launch costs depend on satellite weight.

It is typically desirable that tunable filters exhibit a high loaded-Q value. The loaded-Q value of the tunable filter is determined by the Q value of the filter structure itself and by the insertion loss of the tuning element in use. Currently available systems employ various types of tuning elements. Some are based on semiconductors, ferroelectric materials, ferromagnetic materials, and/or mechanical systems, for instance. Integration of tuning elements within filters can increase insertion loss and result in a lower loaded-Q value.

SUMMARY

Electronic tunability is a relatively new area of research. Although electronic tunability is appealing from the standpoint of size and costs, there remain challenges to be addressed to allow its suitability for some applications.

One general solution is applicable to a bandpass filter system based on a combination of subfilters. In this present disclosure, the term "subfilter" refers to a filter element that is used as a component of a filter system. The passband and the rejection band of the filter system will be referred to herein as the system passband and the system rejection band. The system passband and the system rejection band are determined by the combined action of multiple subfilters. The subfilters can be selected and configured to produce the desired system passband rather than based on individual performance considerations. Accordingly, a bandpass filter system having a high loaded-Q value can be achieved with subfilters having lower loaded-Q values.

In one embodiment, a subfilter can be pre-optimized in order to achieve a desired performance characteristic in the system passband, rather than optimizing its performance over the entire frequency spectrum. Similarly, a bandpass subfilter having two cutoffs can be optimized in a manner to increase the sharpness of the one of the cutoffs that corresponds to a cutoff of the bandpass filter system.

In an embodiment, wideband subfilters having low insertion loss can be used to achieve satisfactory overall performance by optimizing the filter coupling matrix over the system passband.

A given subfilter can be used either in transmission or in reflection, depending on whether the passband or the rejection band of the subfilter corresponds to the system passband.

In accordance with one aspect, there is provided a tunable bandpass filter system having a system passband defined by a first tunable cutoff frequency and a second tunable cutoff frequency. The tunable bandpass filter system has a first subfilter having a first tunable cutoff at the first tunable cutoff frequency and a second subfilter having a second tunable cutoff at the second tunable cutoff frequency. The first subfilter and the second subfilter are connected between an input port and an output port. At least one subfilter of the first and second subfilters is connected to operate in reflection. The tunable system passband corresponds to a portion of a rejection band of the at least one subfilter connected to operate in reflection.

In accordance with another aspect, there is provided a method of operating a tunable bandpass filter system. The tunable bandpass filter system has a tunable system passband defined by a first tunable cutoff frequency and a second tunable cutoff frequency. The tunable bandpass filter system also has a first subfilter having a first tunable cutoff at the first tunable cutoff frequency, and a second subfilter having a second tunable cutoff at the second tunable cutoff frequency. The first subfilter and the second subfilter are connected between a input port and an output port. The method includes: at least one of the first subfilter and the second subfilter reflecting an electromagnetic signal incoming from the input port toward the output port in accordance with a rejection band of its frequency response.

The expression "subfilter" is used herein for the sake of clarity to refer to a filter which forms part of a greater system, typically the "bandpass filter system", and to allow the reader to easily distinguish the whole from the part. The expression "filter" is used generally herein to encompass devices such as lossy filters and pre-optimized filters. The expression "filter" is not intended to imply performance levels except from where specified.

The expression "passband" is also used generally to refer to the transmit frequency band of a bandpass filter (between the two cutoffs), low-pass filter (below the cutoff), high-pass filter (above the cutoff), or bandstop filter (above and below the stop band). The expression "rejection band" is used generally to refer to portions of the frequency response which are outside the passband. The expression "reflection band" is used generally to refer to portions of the frequency response which are reflected by the filter, which typically corresponds to the rejection band.

Many further features, and combinations thereof, concerning the present improvements will appear to those skilled in the art following a reading of the instant disclosure.

DESCRIPTION OF THE FIGURES

In the figures,

FIGS. 100 and 10D are frequency response graphs for the bandpass filter system of FIG. 9A with the subfilters of FIGS. 10A and 10B;

DETAILED DESCRIPTION

Figure 1B:
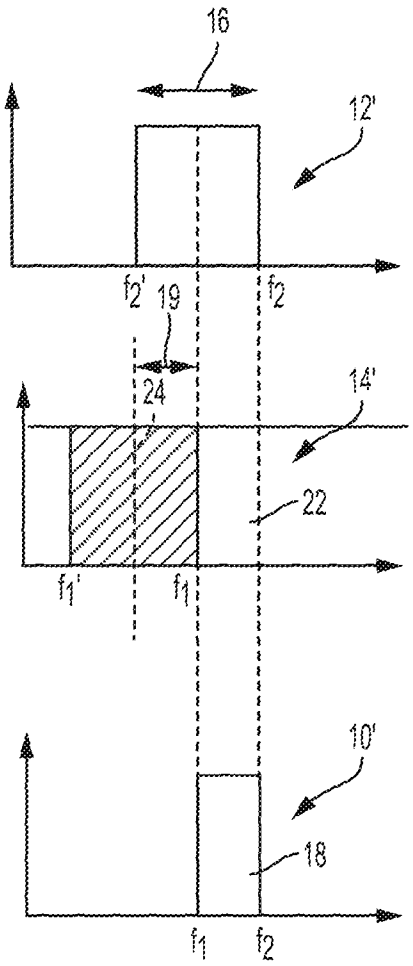
FIG. 1B is a schematic frequency response representation for the bandpass filter system of FIG. 1A.
Figure 1A:
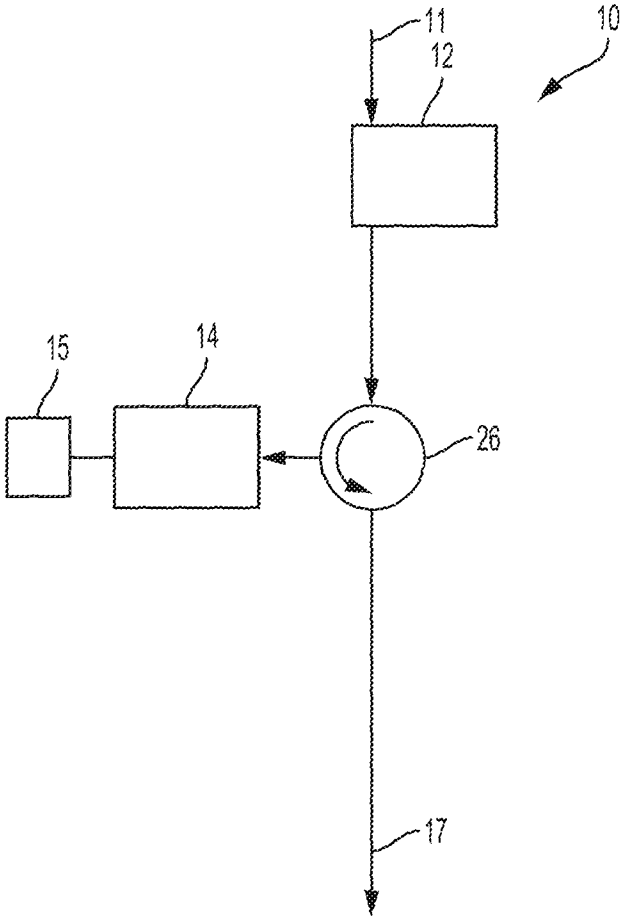
FIG. 1A is a schematic view of a bandpass filter system in accordance with an embodiment.

An example of a tunable bandpass filter system 10 is shown in FIG. 1A. The tunable bandpass filter system has a first subfilter 12 and a second subfilter 14, both of which are tunable bandpass filters. FIG. 1B shows the frequency response 12' of the subfilter 12, and the frequency response 14' of the subfilter 14. The first and second subfilters 12, 14 have wider passbands than the system passband 18 , and will be referred to herein as "wideband subfilters". Wdeband subfilters typically have lower insertion loss than filters with passbands comparable to the system passband 18. In addition, as will be described below in greater detail, a wideband subfilter can be optimized for the performance of a portion of its passband (or rejection band) that corresponds to the system passband 18. As a result, wideband subfilters can be advantageous even if they have a relatively low loaded-Q value. As a result of the width of the passbands 16, 24 of the subfilters 12, 14, the separation 19 between the center frequencies of the passbands 16, 24 of the subfilters 12, 14 will be wider than the system passband 18.

In this example, the first subfilter 12 can be said to operate in a transmission mode. The frequencies within the passband 16 of the subfilter 12 (i.e., the frequencies between the lower cutoff f2' and the higher cutoff f2 in FIG. 1B) are transmitted from an input port 11, across the subfilter 12, towards the second subfilter 14.

The second subfilter 14 can be said to operate in a reflection mode. Referring back to FIG. 1A, a circulator 26 receives the signal from the first subfilter 12, and transmits the signal to the second subfilter 14. The frequencies in the rejection band, or reflection band 22, of the second subfilter 14 are reflected back to the circulator 26, which transmits the frequencies to the output port 17 of the tunable bandpass filter system 10. In the context of subfilters used in reflection, the rejection band of a subfilter may also be referred to herein as a "reflection band". The frequencies within the passband 24 of the subfilter 14 pass through the subfilter 14 and are absorbed by a termination which is preferably a matched load 15 (e.g. a 50-Ω termination). It will be understood that the circulator and matched load arrangement is one possible example of achieving the reflection mode of operation, and that other arrangements can be used. Referring to FIG. 1B, as can be seen from the frequency response 10' of the bandpass filter system 10, the resulting system passband 18 is the range of frequencies between the cutoff f1 of the second subfilter 14 and the cutoff f2 of the first subfilter 12. The system passband 18 consists of frequencies that are both within the passband 16 of the transmission mode subfilter 12 and within the reflection band 22 of the reflection mode subfilter 14.

It should be appreciated that the bandpass filter system 10 can operate as a tunable bandpass filter system 10 if either or both of the subfilters 12, 14 are tunable to vary the frequencies of the cutoffs f1 and/or f2. The bandpass filter system may be configured so that either or both cutoff frequencies are tunable. This tunability can allow adjusting the bandwidth of the bandpass filter system, the center frequency of the passband, or both.

Figure 2B:
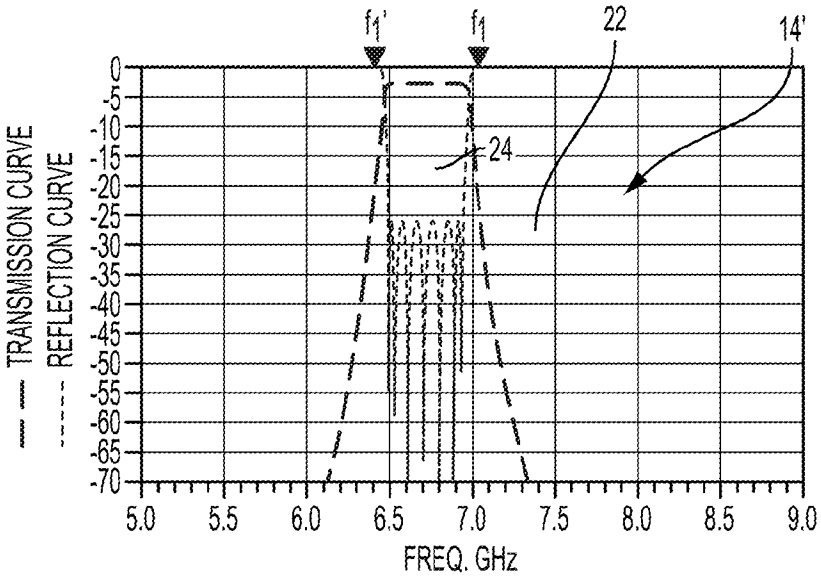
FIGS. 2A and 2B are frequency response graphs for bandpass filters.
Figure 2A:
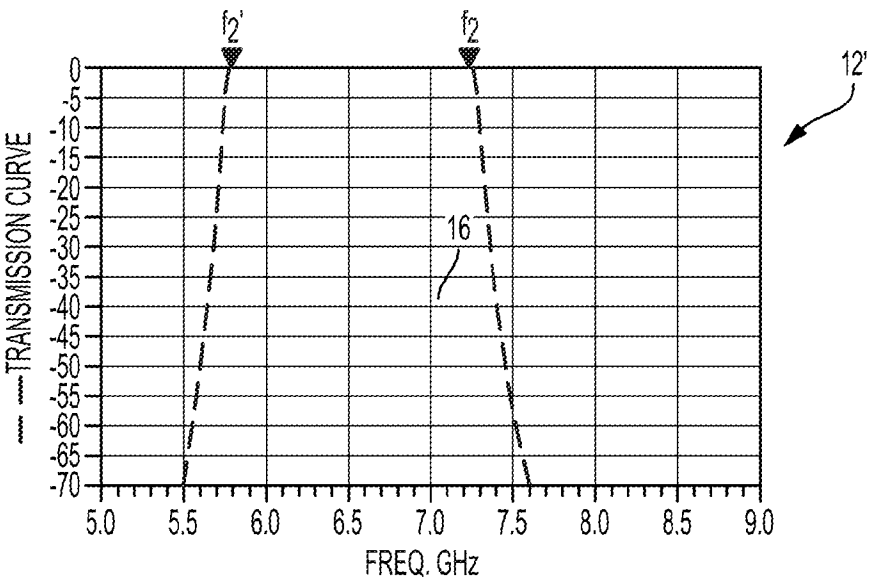
Figure 2D:
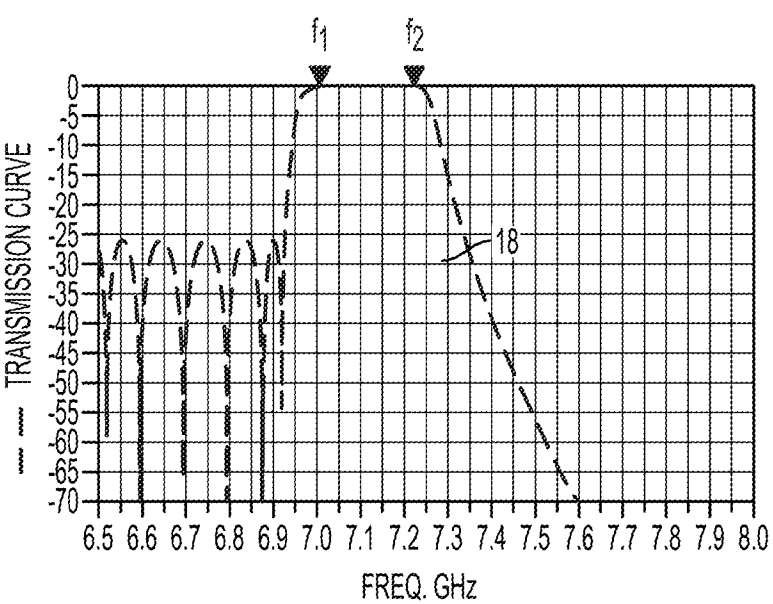
FIGS. 2C and 2D are frequency response graphs for a bandpass filter system embodiment in accordance with the schematic view of FIG. 1A.
Figure 2C:
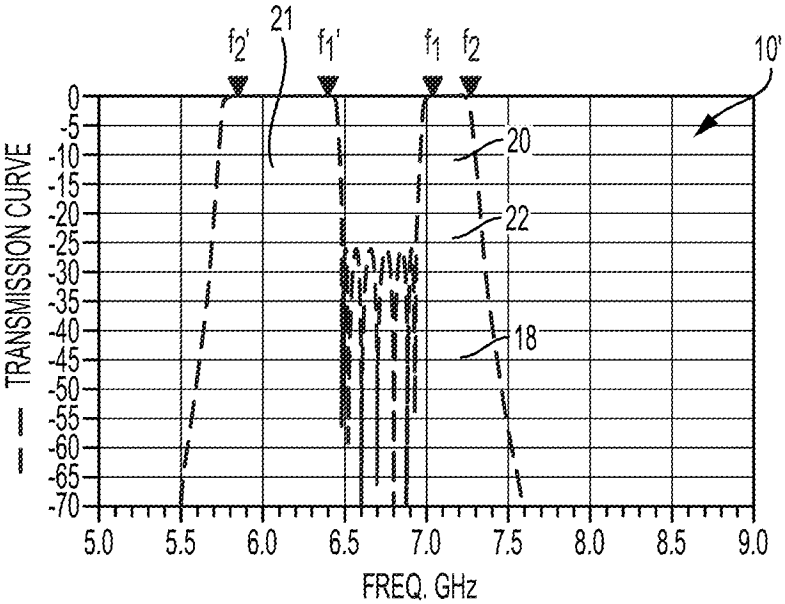

FIGS. 2A to 2D are a more detailed illustration of the behavior of a tunable bandpass filter 10 in the configuration shown in FIG. 1A. FIG. 2A shows the frequency response of a wideband bandpass filter such as the subfilter 12 of FIG. 1A. In this illustration, f2 is the higher cutoff frequency and f2' is the lower cutoff frequency. FIG. 2B shows the frequency response of a bandpass filter with a higher cutoff frequency at f1 and a lower cutoff frequency at f1', similar to the bandpass subfilter 14 of FIG. 1A. FIG. 2C shows the overall response 10'. FIG. 2D shows a portion of FIG. 2C enlarged, corresponding to the passband 18 between f1 and f2. The passband 18 of the bandpass filter system 10 is between the lower cutoff frequency f1 of FIG. 2B and the upper cutoff frequency f2 of FIG. 2A. FIG. 2C shows a second passband 21 at lower frequencies. However, this passband 21 may not affect the operation of the bandpass filter system 10 in some applications, for example when other components of an optical system have a filtering effect that eliminates frequency components below f1'. In such applications, the bandpass filter system 10 can be functionally equivalent to a filter having only a single passband between f1 and f2.

Figure 3A:
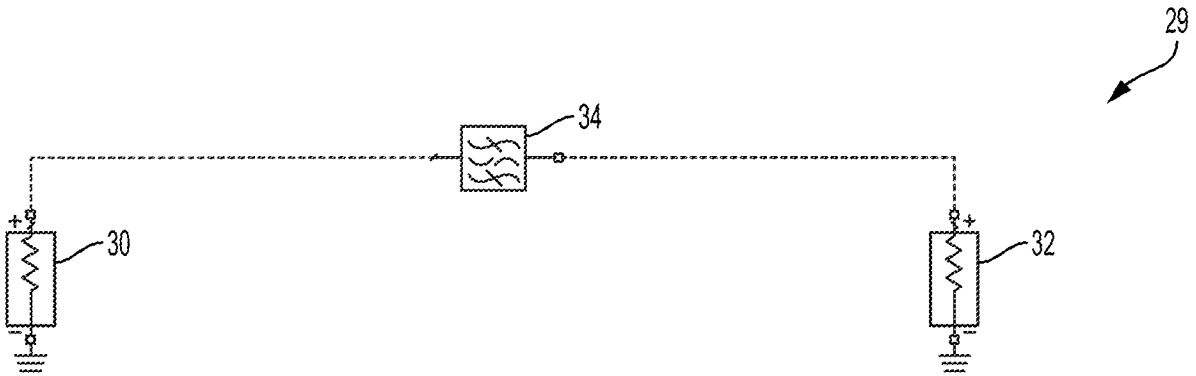
FIGS. 3A, 3B and 3C are different schematic representations of filters.
Figure 3B:
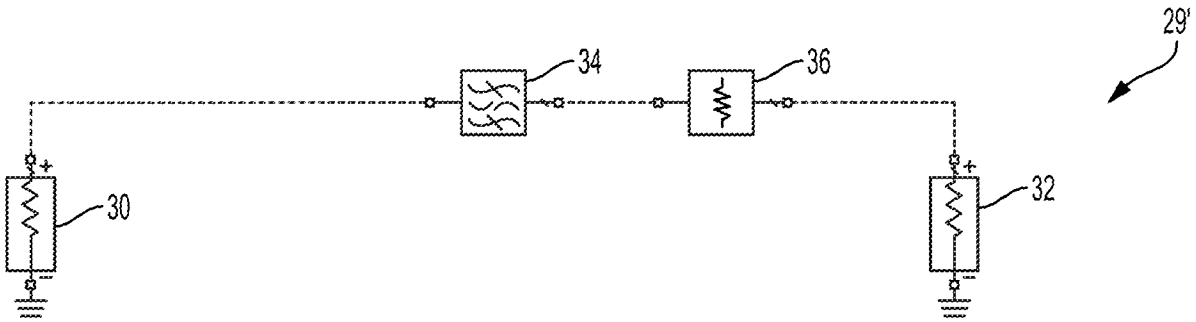
Figure 3C:
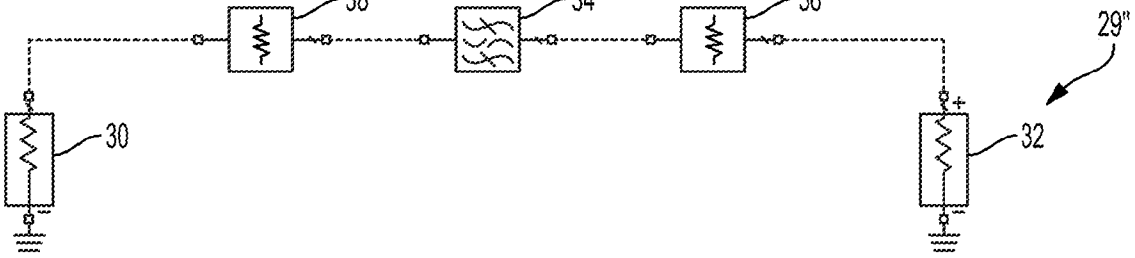
Figure 3D:
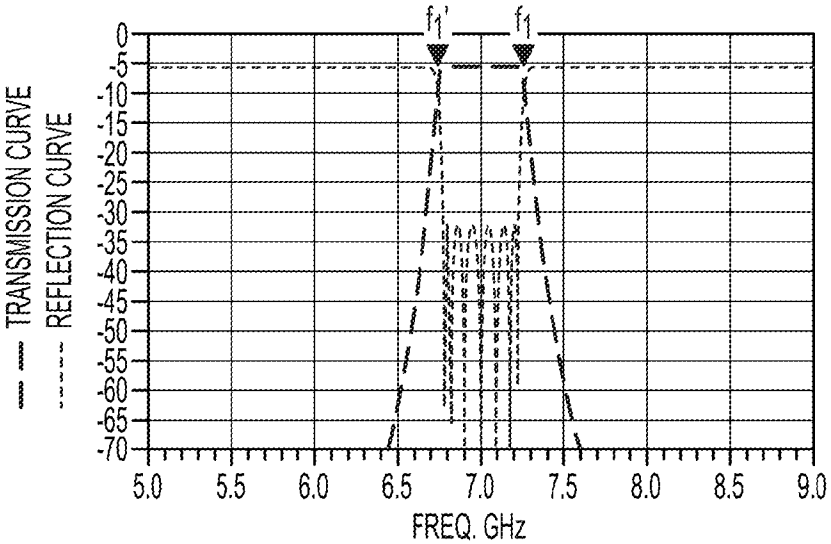
FIG. 3D is a frequency response graph for the filter of FIG. 3C.

Referring to FIG. 3A, the subfilter 29 has an input port 30, an output port 32, and an ideal filter 34. Referring to the embodiment of FIG. 3B, a subfilter 29' is similar to the subfilter 29 of FIG. 3A, and further has a 3 dB attenuator 36 between the ideal filter 34 and the output port 32 represents a loss of 3 dB in transmission and of 0 dB in reflection. The 3 dB attenuation results from pre-optimizing the subfilter 29' to have sharp cutoffs f1 and f1', as will be explained below in greater detail. The frequency response shown in FIG. 2B, with 3 dB loss in the transmission band and no loss in the reflection band, is a typical frequency response of a schematic subfilter structure such as shown in FIG. 3B. Referring to FIG. 3C, an additional attenuator 38" represents an additional loss of 3 dB, for a total loss of 6 dB in both transmission and reflection. FIG. 3D shows a typical frequency response of the subfilter 29" of FIG. 3C, with 6 dB loss in the transmission band and 6 dB loss in the reflection band.

It will be appreciated that, in the embodiment of FIGS. 1A, 1B, and 2A-D, each subfilter 12, 14 generates only one of the two cutoffs f1, f2 of the bandpass filter system 10, and both subfilters 12, 14 pass the frequencies in the system passband 18 to the output port 17. Because each subfilter 12, 14 contributes most significantly to the overall performance at frequencies within the system passband 18, the subfilters 12, 14 can be tuned to optimize performance (e.g., Q value and cutoff sharpness) in this frequency range. It should be noted that the frequency range of the system passband 18 may be outside the passband 24 of the subfilter (e.g. 14), if the subfilter is used in reflection. For example, each subfilter 12, 14 can be optimized to have one sharp cutoff at one cutoff frequency. If this optimization results in attenuation, distortion, shallow cutoff, or other undesirable effects in frequencies outside the system passband 18, these effects may be disregarded because they do not significantly degrade the performance of the bandpass filter system 10. Due to the performance degradation outside the system passband 18, this optimization may be referred to as "detuning".

Figure 4B:
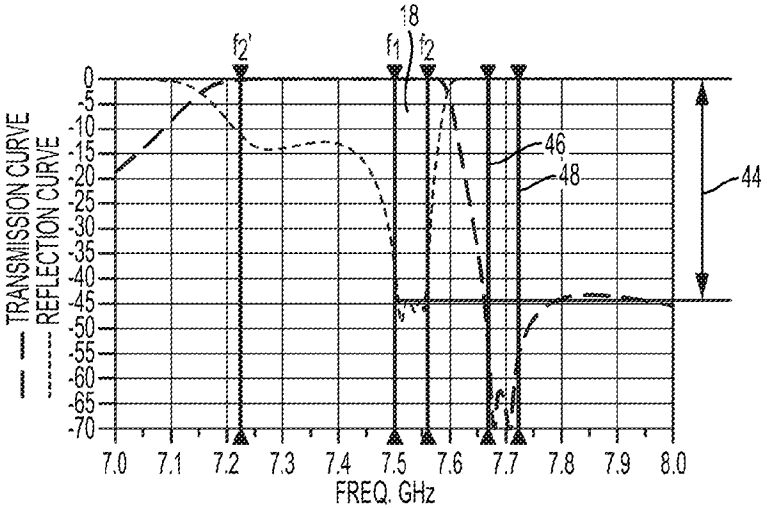
FIGS. 4A and FIG. 4B are frequency response graphs for different configurations of the same bandpass subfilter.
Figure 4A:
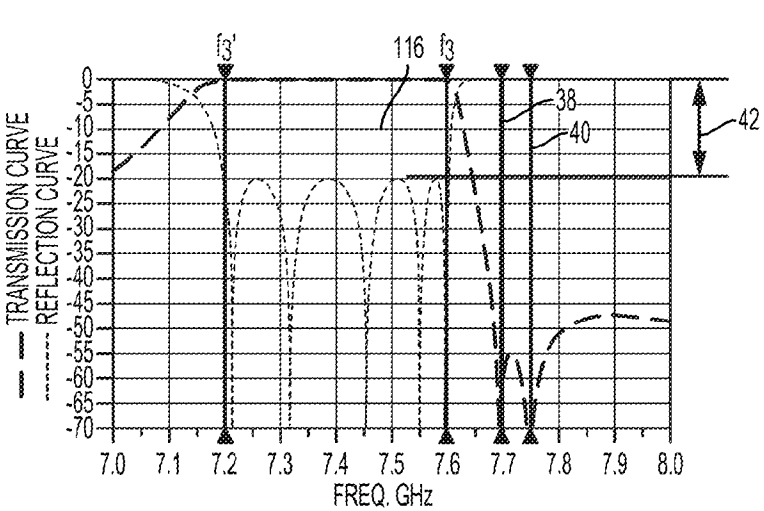

FIG. 4A shows the frequency response of a five-pole, wideband bandpass filter with a passband 116 between cutoff frequencies f3'=7.2 GHz and f3=7.6 GHz. This filter has a −20 dB reflection loss 42 in its passband 116 when used in reflection. The high frequency cutoff f3 has a cutoff sharpness on the order of 0.5 dB/MHz.

FIG. 4B shows the frequency response of the same subfilter, after the subfilter has been pre-optimized to enhance performance of the frequency response in the system passband 18 between frequencies f1 and f2. It can be seen that the frequency response below f1 has been degraded as a result. However, the frequency response of FIG. 4B has a lower return loss of −45 dB, and correspondingly lower insertion loss, in the system passband 18, than the frequency response shown in FIG. 4A. The notches 46, 48 in the rejection band are also pre-optimized to have a higher rejection. The optimizing of the bandpass filter can be performed using software, such as Advanced Design System™ (ADS) optimizer software, available from Keysight Technologies.

Figure 4D:
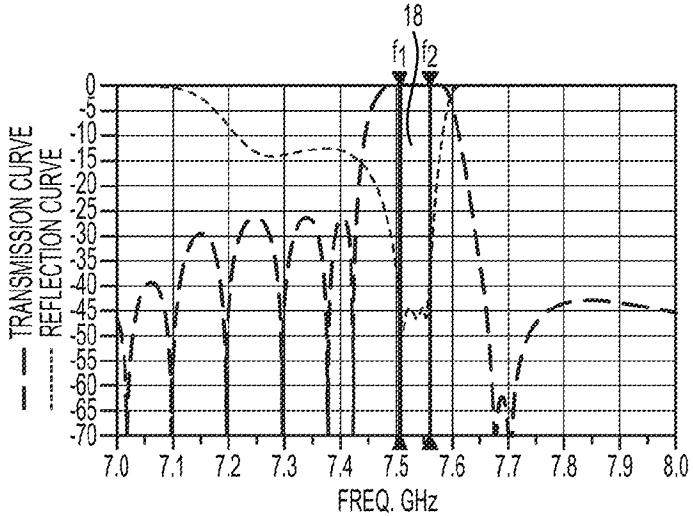
FIG. 4D is a frequency response graph for a bandpass filter system according to an embodiment.
Figure 4C:
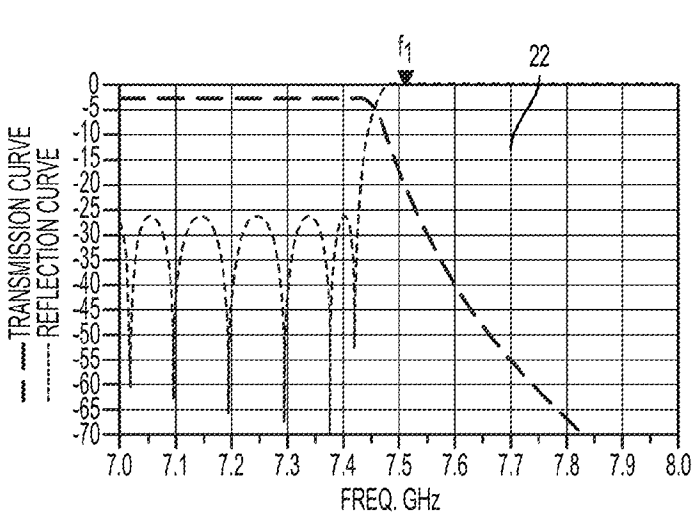
FIG. 4C is a frequency response graph for another subfilter.

FIG. 4C shows the frequency response of a lossy subfilter with a high-pass reflection band 22 having a cutoff frequency f1. FIG. 4D shows the frequency response of a bandpass filter system 10 in the configuration of FIG. 1A, using the subfilter of FIG. 4B in transmission as the subfilter 12, and the subfilter of FIG. 4C in reflection as the subfilter 14. The resulting system passband 18 is between f1 and f2.

Figure 5:
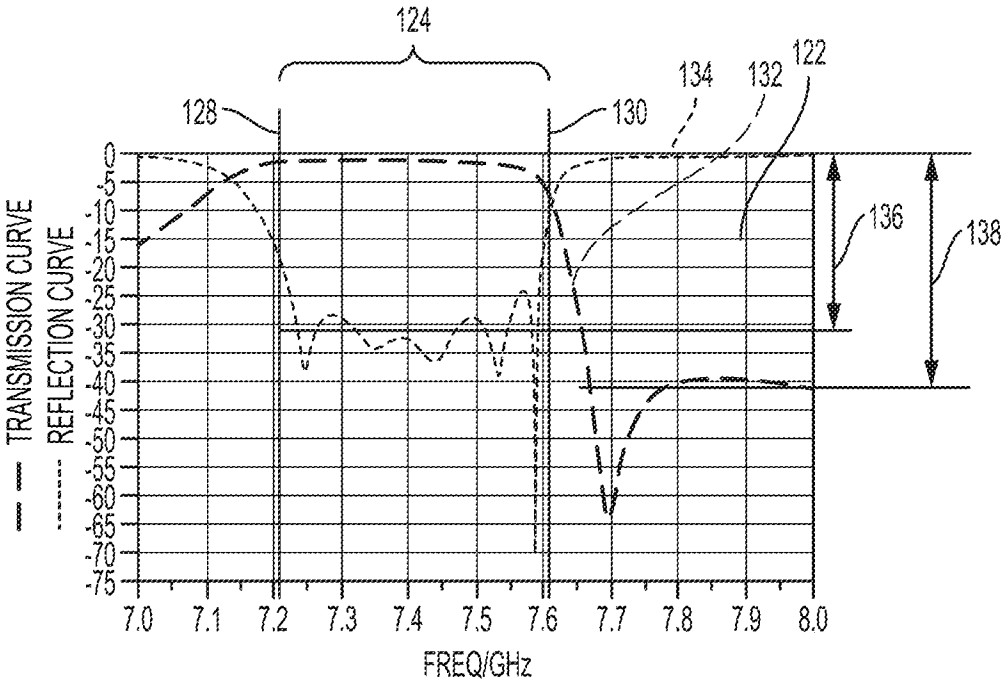
FIG. 5 is a frequency response graph for another subfilter.

FIG. 5 shows the frequency response for an example bandpass filter suitable for use as a subfilter. The passband 124 of the subfilter is delimited by a first cutoff 128 and a second cutoff 130. A low-pass filter having only the cutoff 130 could alternatively be used. Line 132 represents the frequency response in transmission, and line 134 represents the frequency response in reflection, with a 50 ohm resistor used as a termination. The frequency response has a differential 136 of about −30 dB in its passband 124 in transmission, and a differential 138 of about −40 dB in its rejection band 122 in reflection. This subfilter can be used in reflection to take advantage of both the high sharpness of cutoff 130 and the −40 dB differential 138. The result is better performance in the tunable bandpass filter system 10 than in an embodiment using the same subfilter in transmission.

In general, when a subfilter is used in reflection rather than in transmission, the frequency response of the subfilter outside its passband 24 (in its reflection band 22) affects the passband response of the bandpass filter system. Typically, one cutoff and an adjacent portion of the reflection band of the subfilter will correspond to one cutoff and the passband of the bandpass filter system. Accordingly, a subfilter that has a desired performance characteristic in a portion of the passband adjacent to a cutoff frequency can be used in transmission, and a subfilter that has a desired performance characteristic in a portion of the rejection band adjacent to a cutoff frequency can be used in reflection.

Figure 6A:
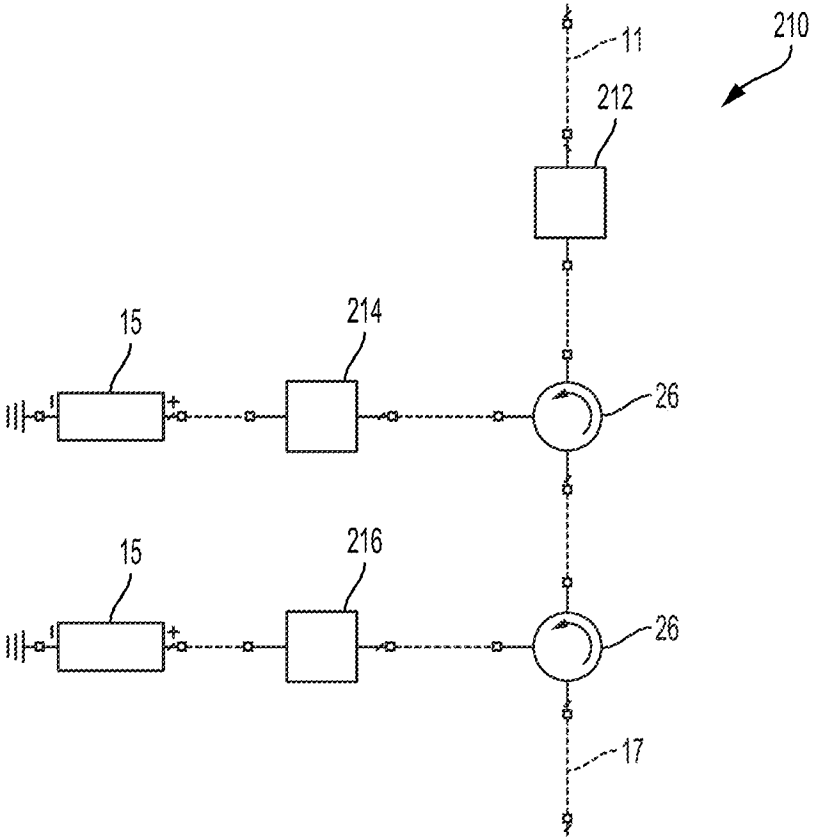
FIG. 6A is a schematic view of a bandpass filter system in accordance with an embodiment.
Figure 6C:
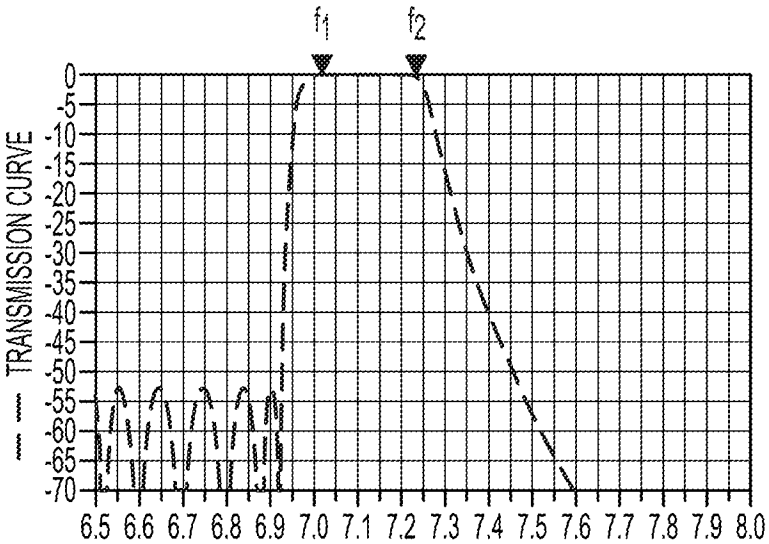
FIGS. 6B and 6C are frequency response graphs for the bandpass filter system of FIG. 6A.
Figure 6B:
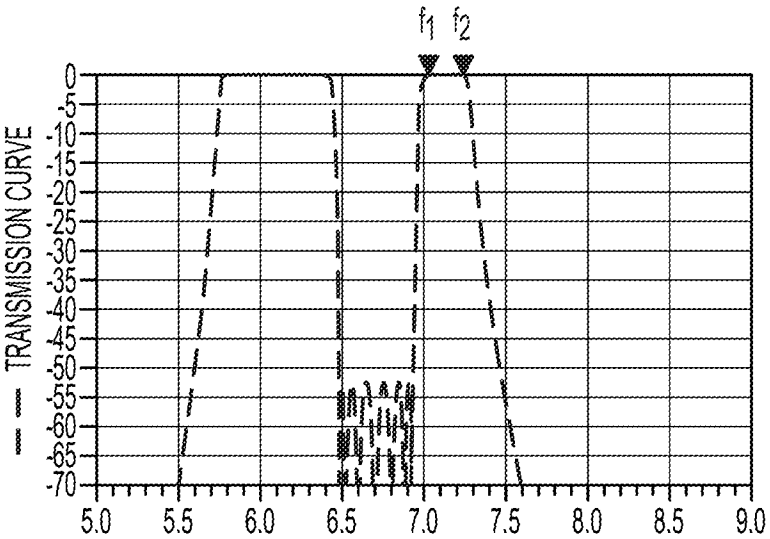

Improved performance can be realized by using a combination of two subfilters having the same function, rather than a single subfilter. Referring to FIG. 6A, a bandpass filter system 210 includes three subfilters 212, 214, 216. The first subfilter 212 can have the frequency response shown in FIG. 2A. The second subfilter 214 and the third subfilter 216 can each have the frequency response shown in FIG. 2B. This configuration can be used to increase out of band (left-side) rejection at the output, compared to the embodiment of FIG. 1A. The frequency response for the bandpass filter system 210 is shown in FIGS. 6B and 6C. It can be seen that the attenuation in the rejection band below f1 is about −52 dB, compared to −26 dB in FIG. 2D.

Figure 7B:
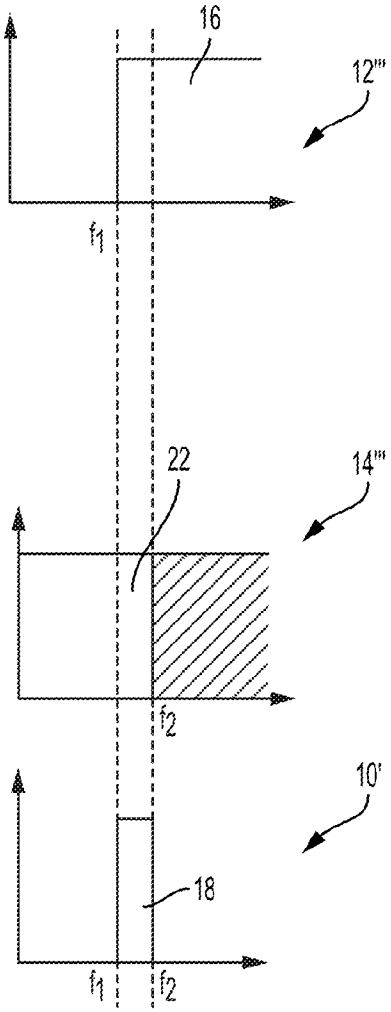
FIGS. 7A and 7B are schematic frequency response representations for the bandpass filter system of FIG. 1A.
Figure 7A:
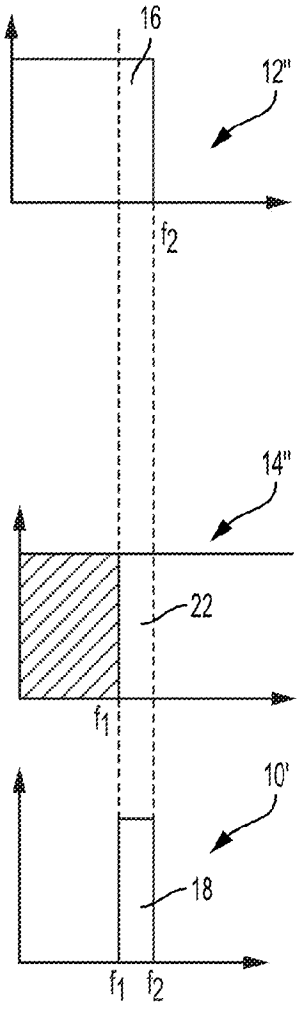

In other embodiments, the subfilters can be low-pass or high-pass subfilters instead of bandpass subfilters. FIG. 7A shows an embodiment using two low-pass subfilter frequency responses 12", 14", and FIG. 7B shows an example embodiment using two high-pass subfilter frequency responses 12''', 14'''. In all these embodiments, the subfilters can be electronically tunable.

Figure 8C:
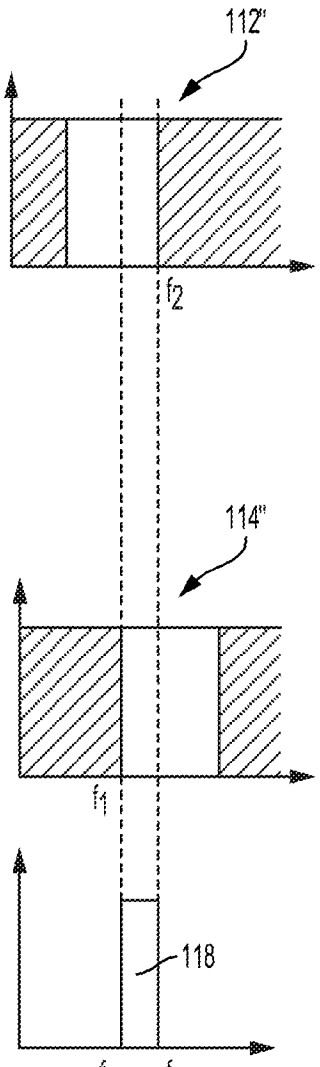
FIGS. 8B and 8C are schematic frequency response representations for the bandpass filter system of FIG. 8A.
Figure 8B:
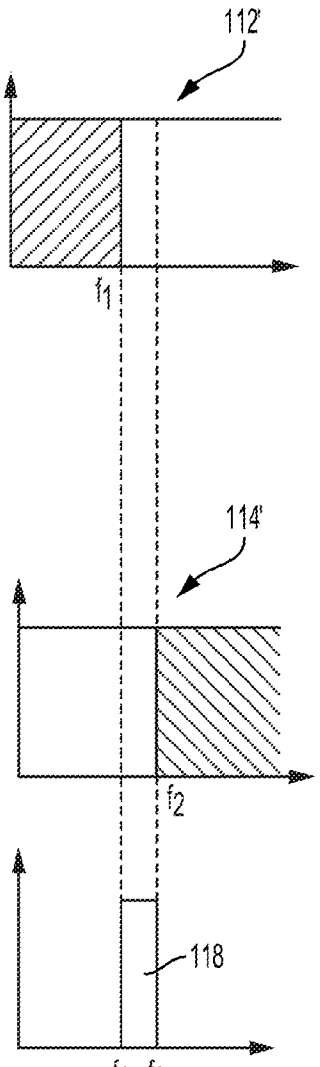
Figure 8A:
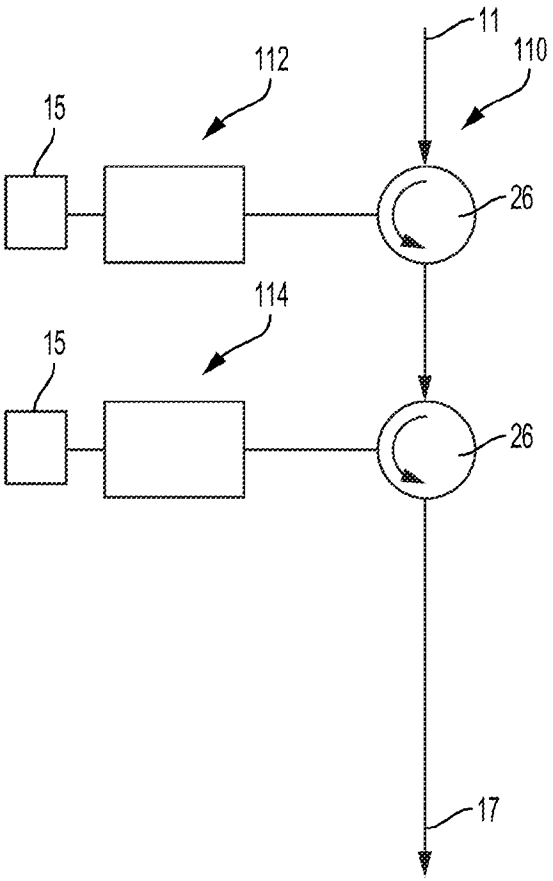
FIG. 8A is a schematic view of a bandpass filter system in accordance with an embodiment.

Another embodiment is shown in FIG. 8A. In this embodiment, both subfilters 112, 114 are used in reflection. FIG. 8B shows the schematic frequency responses of a low-pass subfilter 112' used in reflection and a high-pass subfilter 114' used in reflection. FIG. 8C shows the frequency responses of two bandstop subfilters 112", 114" used in reflection. In an alternative embodiment, the two subfilters 112, 114 used in reflection mode can be bandpass subfilters. It will be appreciated that, regardless of the subfilter types used, the system passband 118 of the resulting bandpass filter system 110 corresponds to the overlap in the reflection bands of the component subfilters 112, 114.

In all the scenarios described above, one or more of the subfilters used in reflection can be lossy filters. An example of a lossy filter is provided in Vahid Miraftab et al, "Advanced Coupling Matrix and Admittance Function Synthesis Techniques for Dissipative Microwave Filters", IEEE MTT Trans. 2009. Lossy filters can advantageously have a sharp cutoff, typically at the expense of insertion loss in the passband. However, if the subfilter is used in reflection, the loss in the passband may not adversely affect the performance of the bandpass filter system, because the loss occurs in the rejection band of the bandpass filter system.

Figure 9B:
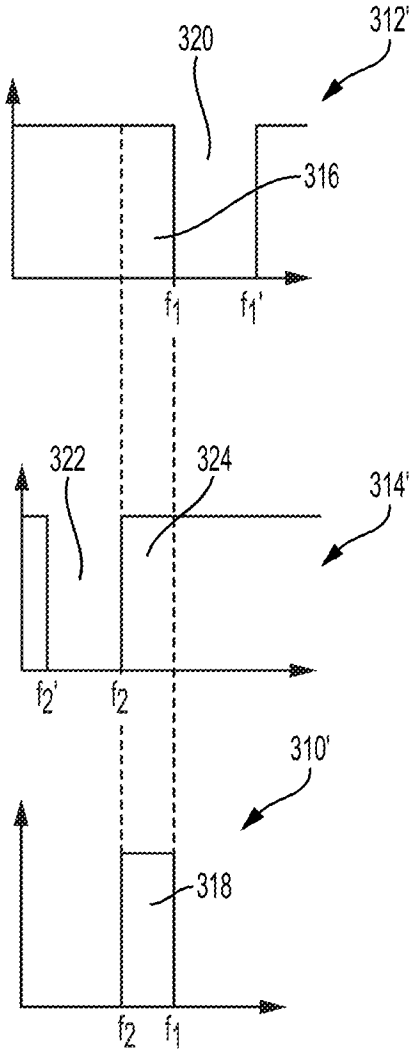
FIG. 9B is a schematic frequency response representation for the bandpass filter system of FIG. 9A.
Figure 9A:
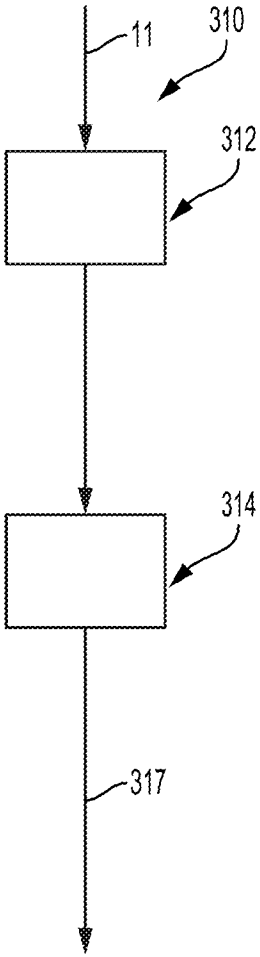
FIG. 9A is a schematic view of a bandpass filter system in accordance with an embodiment.

FIG. 9A shows a bandpass filter system 310 having two subfilters 312, 314 used in transmission. FIG. 9B illustrates the frequency response 312' of the first subfilter 312, the frequency response 314' of the second subfilter 314, and the overall frequency response 310' of the bandpass filter system 310. The passband 318 between f1 and f2 corresponds to the overlapping portions of the passbands 316, 324 of the subfilters 312, 314 between their respective rejection bands 320, 322.

Figure 10B:
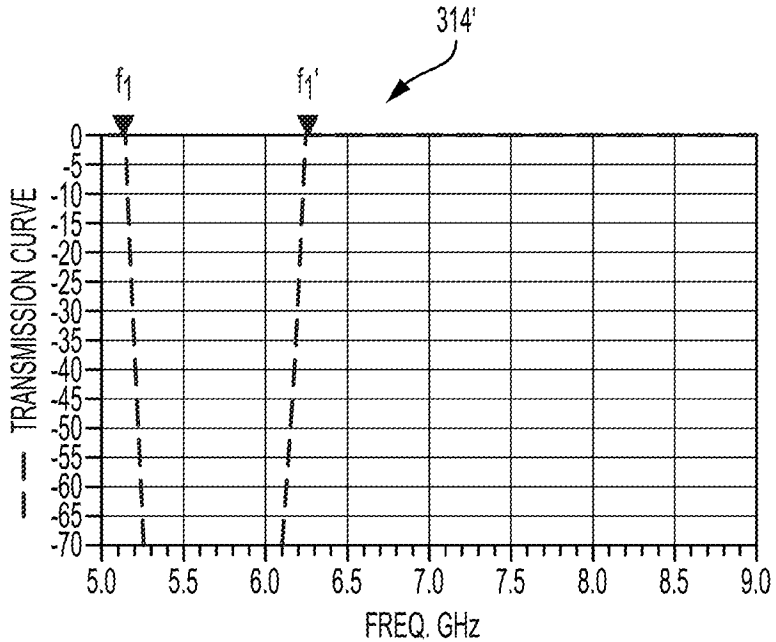
FIGS. 10A and 10B are frequency response graphs of different bandstop subfilters.
Figure 10A:
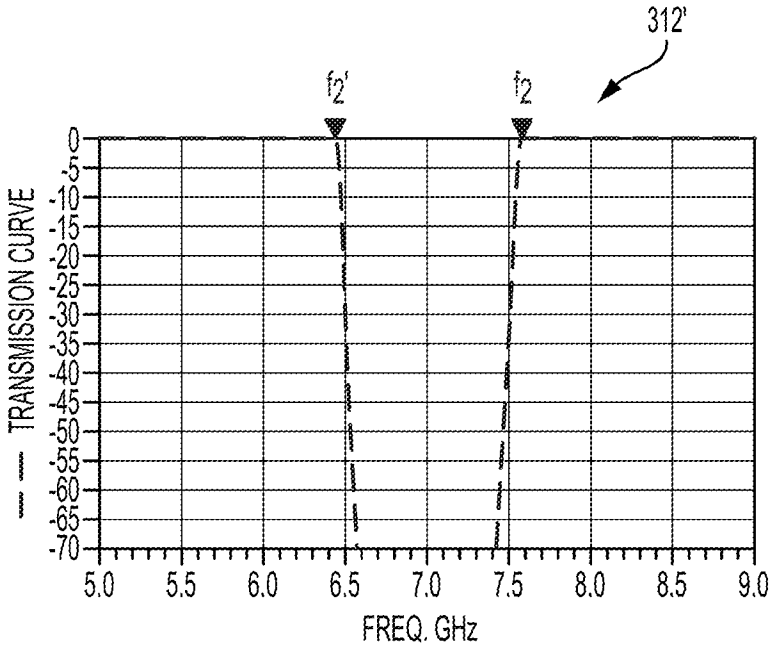
Figure 10D:
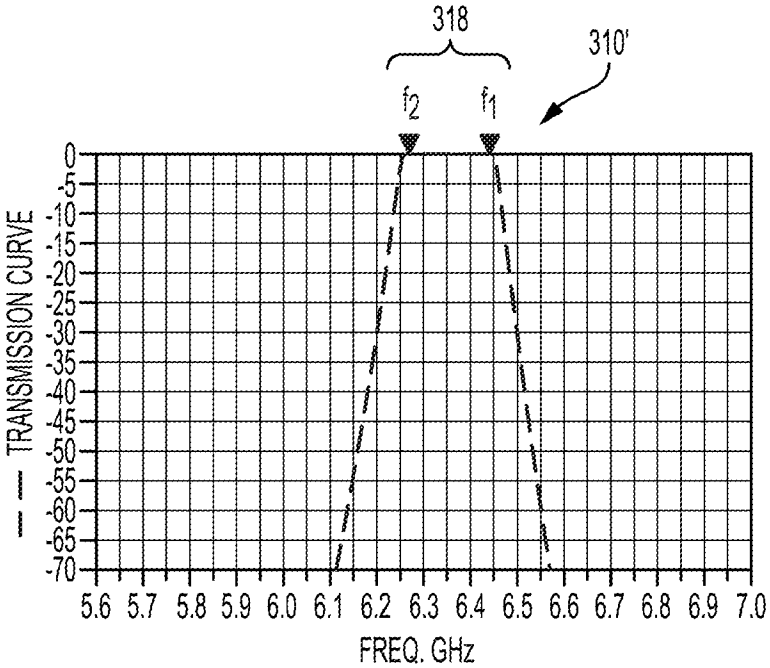
Figure 10C:
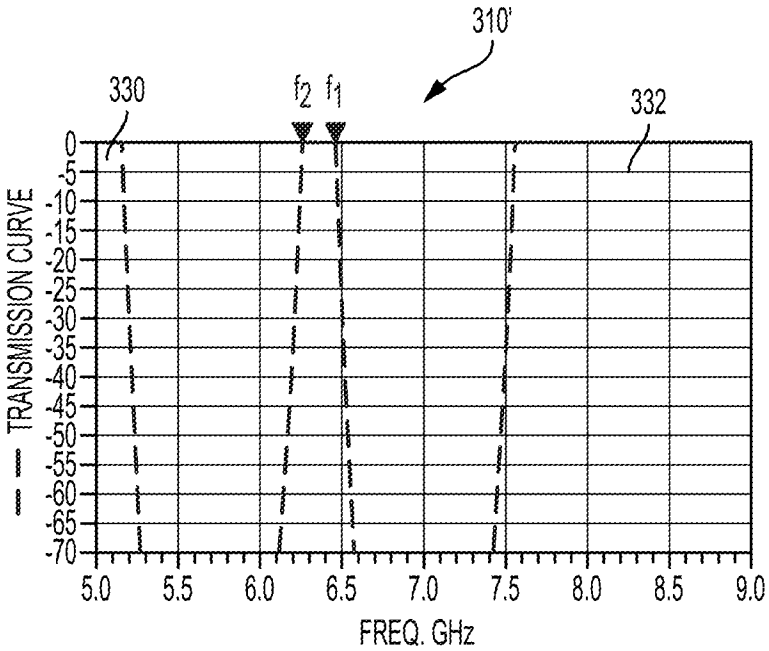

FIGS. 10A-10D show an example of the frequency responses of two bandstop subfilters 312', 314' that can be used in the arrangement of FIG. 9A. The difference between the frequency f2 in FIG. 10A and the frequency f1 in FIG. 10B corresponds to the bandwidth 218 of the bandpass filter system 310'. FIG. 10A shows the frequency response 312' of the first bandstop sub-filter 312, which has a higher cutoff frequency f2 and a lower cutoff frequency f2'. FIG. 10B shows the frequency response 314' of the second bandstop subfilter 314, which has a higher cutoff frequency f1' and a lower cutoff frequency at f1. FIG. 100 shows the frequency response 310' at the output port 317 of the bandpass filter system 310. FIG. 10D shows an enlarged view of a portion of FIG. 100. It should be understood that, in this arrangement, the order of the two subfilters 312, 314 does not affect the frequency response of the bandpass filter system 310. It should also be understood that this arrangement may have additional passbands 330, 332 at higher or lower frequencies than the passband 318 between f2 and f1. These passbands 330, 332 may not affect the operation of the bandpass filter system 310 in some applications, for example when other components of an optical system have a filtering effect that eliminates frequency components in these ranges.

Some examples of filters that are suitable for use as subfilters in embodiments described herein can be found in Zhang, R.; Mansour, R. R., "Novel tunable lowpass filters using folded slots etched in the ground plane," in Microwave Symposium Digest, 2005 IEEE MTT-S International, vol., no., pp. 4 pp.-, 12-17 Jun. 2005, the contents of which are incorporated herein by reference. Other suitable subfilters will be known to persons of ordinary skill in the art.

Figure 11:
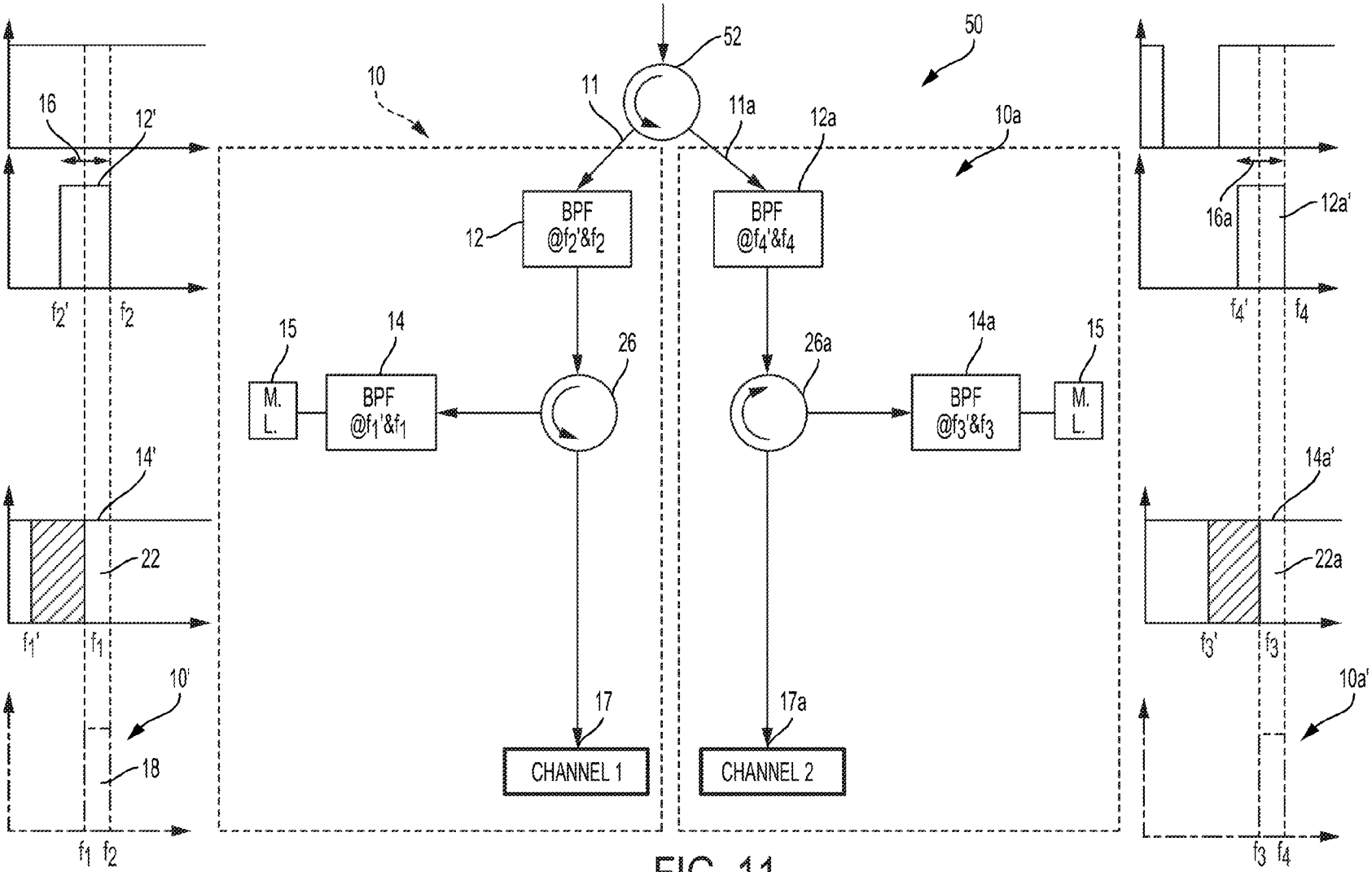
FIG. 11 is a schematic view representing an example two-channel multiplexer, or diplexer, using two bandpass filter systems such as shown in FIGS. 1A and 1B.
Figure 12:
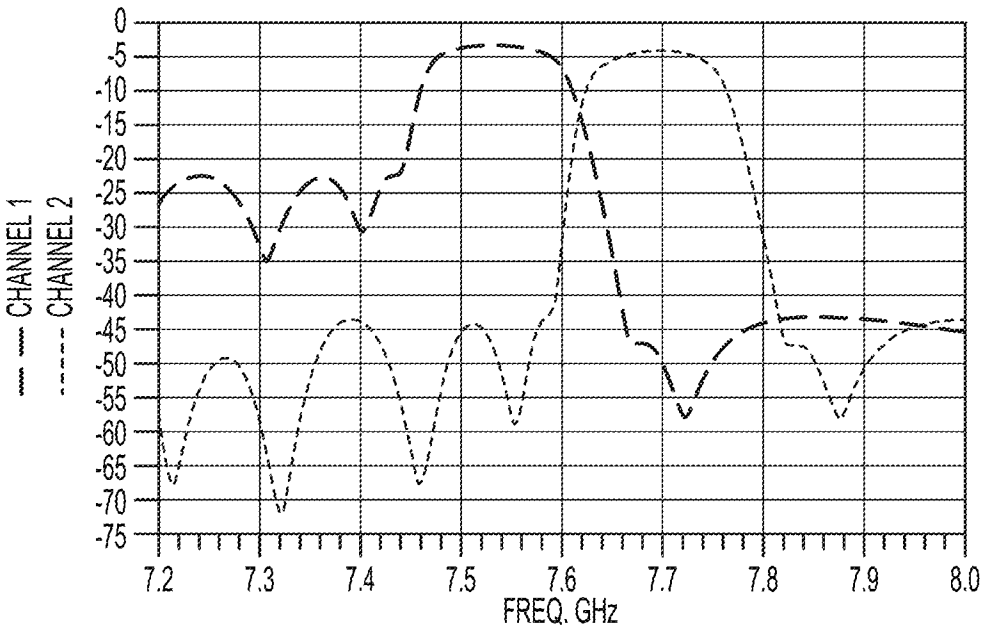
FIG. 12 is a graph showing an example frequency response for the diplexer of FIG. 11.

FIG. 11 shows an example of a two-channel multiplexer 50, or diplexer, which includes two bandpass filter systems 10, 10*a* as described above with reference to FIG. 1A. Each of the bandpass filter systems 10, 10*a* has two subfilters 12, 12*a*, 14, 14*a* having frequency responses 12', 14', 12*a'*, 14*a'*. The input port 11, 11*a* of each bandpass filter system 10, 10*a* is connected to a common circulator 52. The frequencies in the passband 16 of the subfilter 12 are transmitted to the circulator 26. The frequencies in the rejection band 22 of the subfilter 14 are transmitted by the circulator 26 to the output 17. Similarly, the frequencies in the passband 16*a* of the subfilter 12*a* are transmitted to the circulator 26*a*. The frequencies in the reflection band 22*a* of the subfilter 14*a* are transmitted by the circulator 26 to the output 17*a* and, at that point, exhibit frequency response 10*a'*. Each bandpass filter system 10, 10*a* operates similarly to the embodiment of FIG. 1A. It should be further understood that each bandpass filter system 10, 10*a* may use any of the embodiments of bandpass filter systems described above. An example frequency response achieved with a two-channel multiplexer 50 such as shown in FIG. 11 is shown in FIG. 12.

Figure 13:
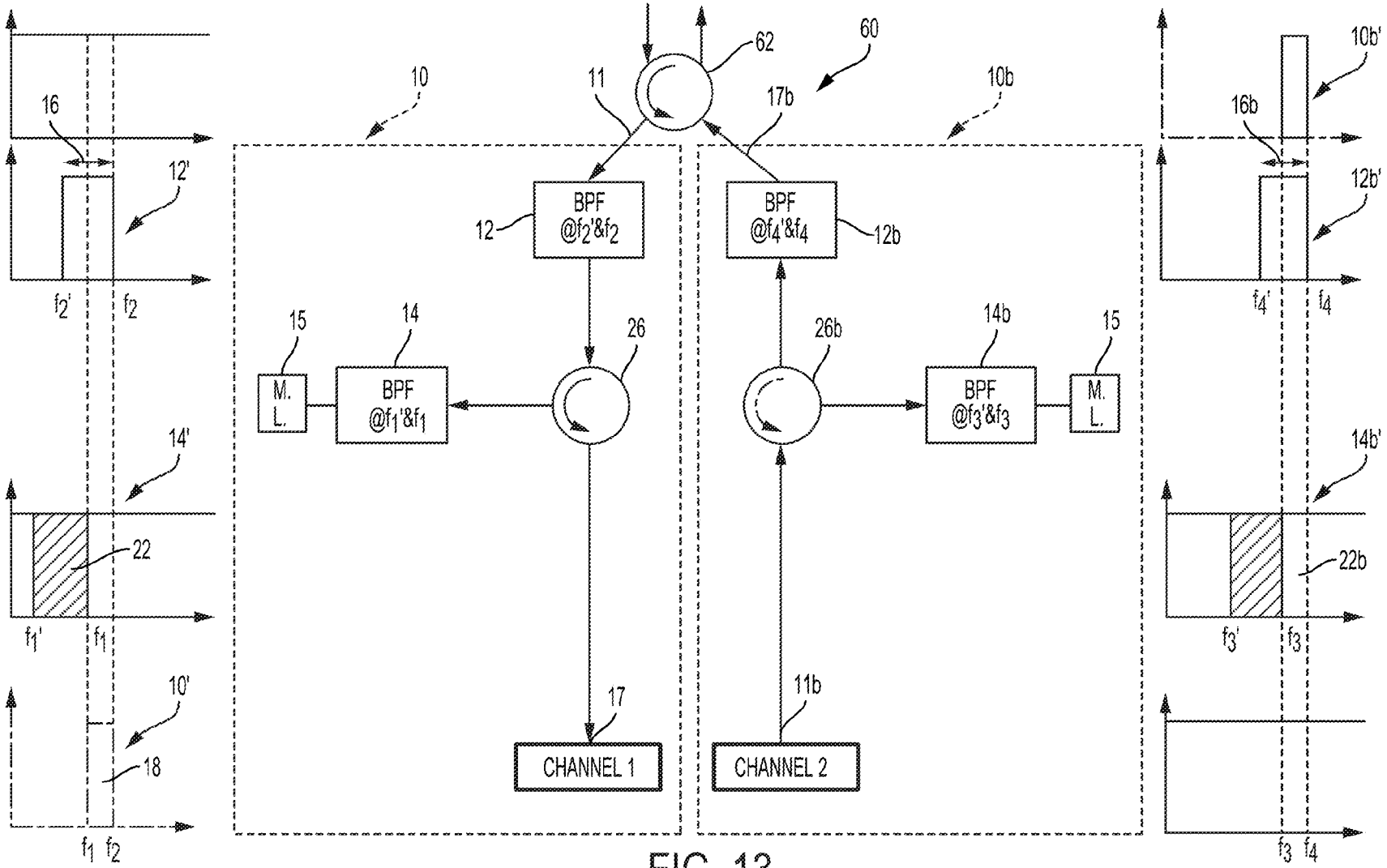
FIG. 13 is a schematic view representing an example of a duplexer using two bandpass filter systems such as shown in FIGS. 1A and 1B.

FIG. 13 shows an example of a duplexer 60 which includes two bandpass filter systems 10, 10*b* as described above with reference to FIG. 1A. Each of the two bandpass filter systems 10, 10*b* has two subfilters 12, 14, 12*b*, 14*b*, exhibiting frequency responses 12', 14', 12*b'*, 14*b'* respectively. The signal flow direction through the bandpass filter system 10*b* is reversed relative to the embodiment of FIG. 11. The circulator 62 transmits an incoming signal to the first bandpass filter 10. A signal received at the input port 11*b* of the second bandpass filter system 10*b* is transmitted to the second bandpass subfilter 14*b* via the circulator 26*b*. The frequencies in the rejection band 22*b* of the subfilter 14*b* are transmitted by the circulator 26*b* to the subfilter 12*b*. The frequencies in the passband 16*b* of the subfilter 12*b* are transmitted to the output port 17*b* which leads to the circulator 62. The circulator 62 also transmits the signal received from the second bandpass filter 10*b*.

In FIG. 11 and FIG. 13, the subfilters can be wideband tunable bandpass subfilters. The bandpass filter systems shown in FIG. 11 and FIG. 13 are tunable. It should be understood that appropriate low-pass, high-pass, or bandstop filters may alternatively be used.

Figure 14:
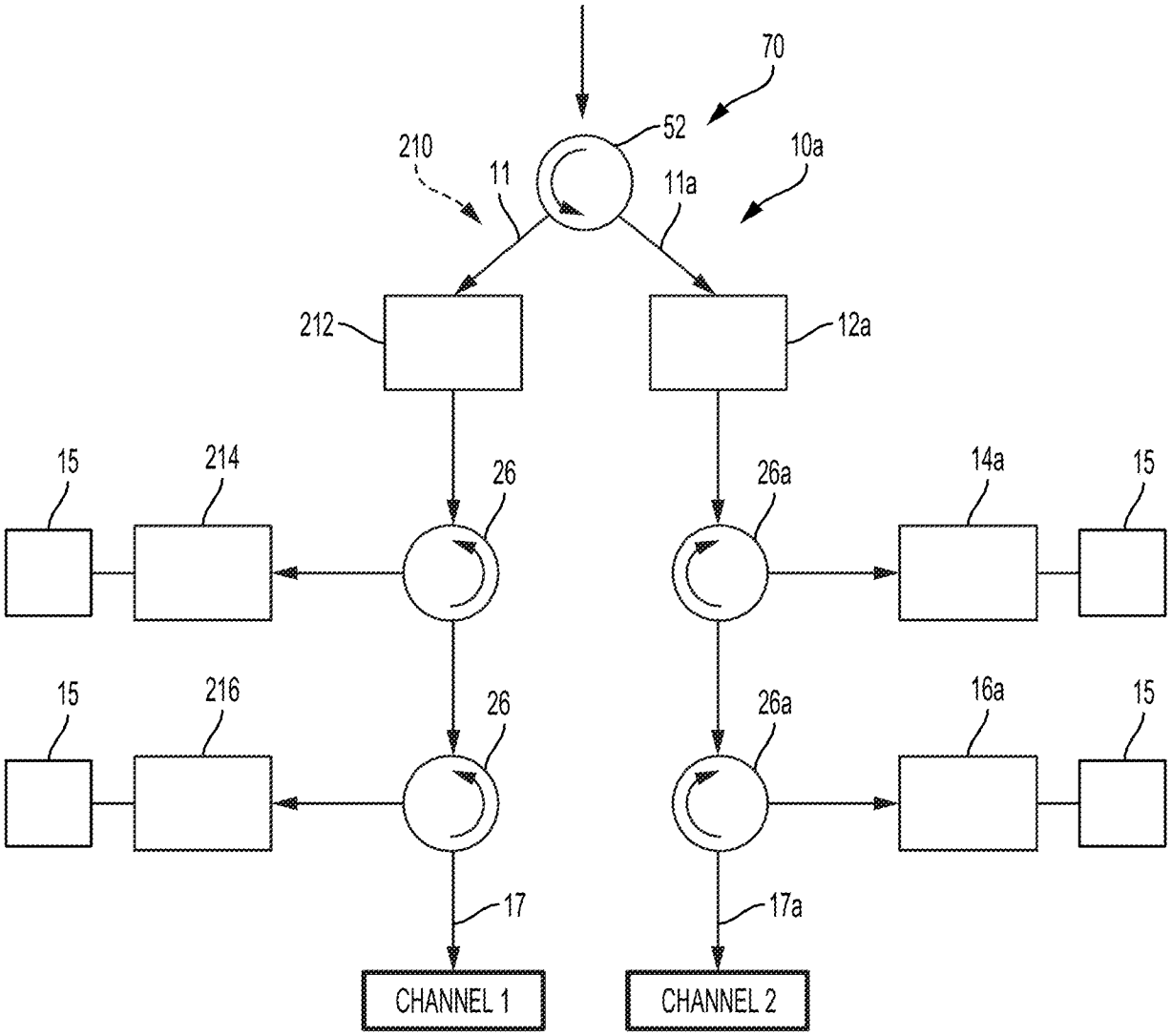
FIG. 14 is a schematic view showing another example of a diplexer having an additional pair of subfilters and circulators.
Figure 15:
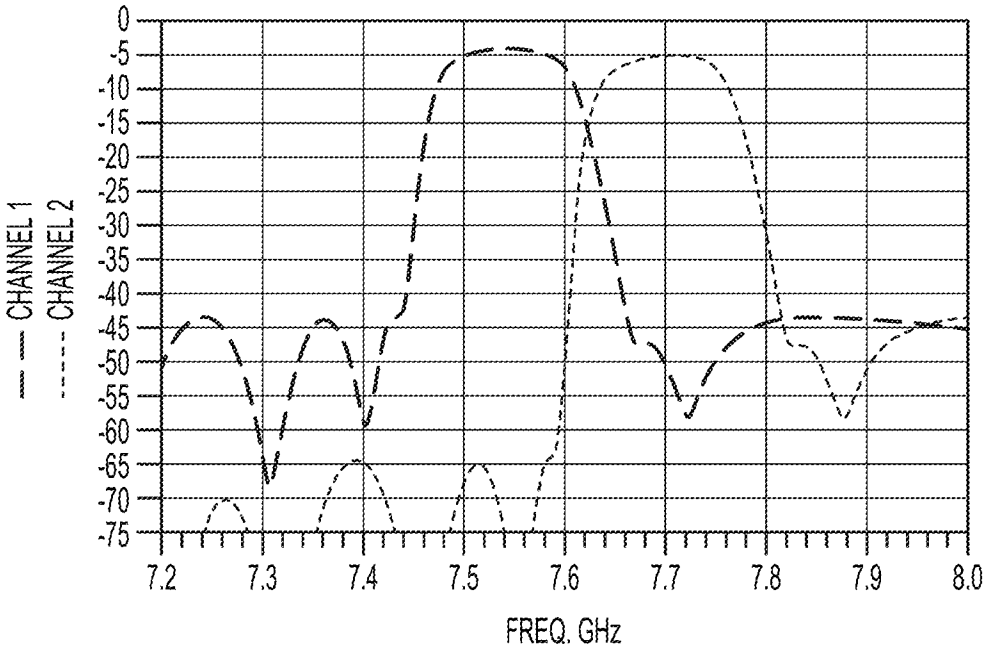
FIG. 15 is a graph showing an example frequency response for the diplexer of FIG. 13.

Referring to FIG. 14, a configuration such as described in FIG. 6A can be used in order to improve the rejection in the embodiment of FIG. 11. In FIG. 14 a third subfilter 216, 16*a* and additional circulators 26 and 26*a* can be used in each bandpass filter system 210, 10*a*. The third subfilter 216, 16*a* used in reflection further attenuates the frequencies in its passband, which further improves the rejection level of frequencies in that band. An example frequency response achieved with a two-channel multiplexer 70 such as shown in FIG. 14 is shown in FIG. 15.

Certain embodiments can be specifically adapted to base station applications, mobile communications, or satellite communication applications, for instance.

As can be understood, the examples described and illustrated above are intended to be examples only. The scope is indicated by the appended claims.

What is claimed is:

1. A tunable bandpass filter system having a system passband defined by a first tunable cutoff frequency and a second tunable cutoff frequency, the tunable bandpass filter system comprising:

a first subfilter having a first tunable cutoff at the first tunable cutoff frequency;

a second subfilter having a second tunable cutoff at the second tunable cutoff frequency;

the first subfilter and the second subfilter being connected between an input port and an output port, at least one subfilter of the first and second subfilters being connected to operate in reflection, such that the tunable system passband corresponds to a portion of a rejection band of the at least one subfilter connected to operate in reflection.

2. The tunable bandpass filter system of claim 1 wherein the at least one subfilter connected to operate in reflection is connected to a circulator such that the at least one subfilter receives the signal from the circulator and returns a reflected signal back to the circulator.

3. The tunable bandpass filter system of claim 1 wherein the at least one subfilter connected to operate in reflection is a lossy filter.

4. The tunable bandpass filter system of claim 1 wherein both the first and the second subfilters are connected to operate in reflection.

5. The tunable bandpass filter system of claim 4 wherein the first subfilter is a low-pass subfilter and the second subfilter is a high-pass subfilter.

6. The tunable bandpass filter system of claim 1 wherein at least one of the first subfilter and the second subfilter is a wideband filter.

7. The tunable bandpass filter system of claim 6 wherein the at least one wideband filter is one of a bandpass subfilter having a subfilter passband wider than the system passband and a bandstop subfilter having a subfilter rejection band wider than the system passband.

8. The tunable bandpass filter system of claim 7 wherein the subfilter passband and the subfilter rejection band is at least twice as wide as the system passband.

9. The tunable bandpass filter system of claim 7 wherein the subfilter passband and the subfilter rejection band is at least four times as wide as the system passband.

10. The tunable bandpass filter system of claim 7 wherein both the first subfilter and the second subfilter are wideband filters.

11. The tunable bandpass filter system of claim 7 wherein the subfilter passband and the subfilter rejection band have a non-uniform response with a greater difference between a transmission curve and a reflection curve in a portion corresponding to the system passband than in a portion outside the system passband.

12. The tunable bandpass filter system of claim 1 wherein at least one of the first subfilter and the second subfilter is a bandpass subfilter.

13. The tunable bandpass filter system of claim 12 wherein both the first subfilter and the second subfilter are bandpass subfilters, one of which is connected in reflection.

14. The tunable bandpass filter system of claim 12 wherein the bandpass subfilter further has an additional tunable cutoff.

15. The tunable bandpass filter system of claim 1 further comprising a third subfilter having a third tunable frequency response, also being connected in reflection between the input port and the output port.

16. The tunable bandpass filter system of claim 1 wherein:

one of the first subfilter and the second subfilter is connected to operate in reflection;

the first subfilter is one of a low-pass subfilter and a high-pass subfilter; and the second subfilter is one of a low-pass subfilter and a high-pass subfilter.

17. The tunable bandpass filter system of claim 1 wherein:

the first subfilter is one of a bandpass subfilter, a low-pass subfilter, a high-pass subfilter, and a bandstop subfilter; and the second subfilter is one of a bandpass subfilter, a low-pass subfilter, a high-pass subfilter, and a bandstop subfilter.

18. A method of operating a tunable bandpass filter system having a tunable system passband defined by a first tunable cutoff frequency and a second tunable cutoff frequency, a first subfilter having a first tunable cutoff at the first tunable cutoff frequency, and a second subfilter having a second tunable cutoff at the second tunable cutoff frequency, the first subfilter and the second subfilter being connected between a input port and an output port, the method comprising:

at least one of the first subfilter and the second subfilter reflecting an electromagnetic signal incoming from the input port toward the output port in accordance with a rejection band of its frequency response.

19. The method of claim 18 further comprising a circulator directing the incoming electromagnetic signal to the at least one subfilter and directing the reflected electromagnetic signal to the output port.

* * * * *